US006952893B1

(12) United States Patent
Sanderson

(10) Patent No.: US 6,952,893 B1
(45) Date of Patent: Oct. 11, 2005

(54) CHUTE RETENTION DEVICE

(75) Inventor: Donald Richard Sanderson, Middleburg Heights, OH (US)

(73) Assignee: MTD Products Inc, Valley City, OH (US)

( * ) Notice: Subject to any disclaimer, the term of this patent is extended or adjusted under 35 U.S.C. 154(b) by 0 days.

(21) Appl. No.: 10/865,653

(22) Filed: Jun. 10, 2004

(51) Int. Cl.[7] ..... E01H 5/09
(52) U.S. Cl. ..... 37/261
(58) Field of Search ..... 37/260, 261, 241, 37/242, 243, 244, 246, 248, 249, 253, 254, 37/257, 258

(56) References Cited

U.S. PATENT DOCUMENTS

| | | | | |
|---|---|---|---|---|
| 3,078,603 | A * | 2/1963 | Ertsgaard et al. | 37/252 |
| 3,552,045 | A * | 1/1971 | Fieber | 37/260 |
| 3,760,517 | A * | 9/1973 | Blaauw | 37/260 |
| 3,808,715 | A * | 5/1974 | Haban | 37/260 |
| 3,879,866 | A * | 4/1975 | Gunderson | 37/260 |
| 4,951,403 | A * | 8/1990 | Olmr | 37/262 |
| 5,083,387 | A | 1/1992 | Tillotson et al. | |
| 5,315,771 | A * | 5/1994 | White et al. | 37/260 |
| 5,758,436 | A * | 6/1998 | Harms | 37/249 |
| 2003/0154632 | A1 * | 8/2003 | Dowe et al. | 37/196 |

* cited by examiner

*Primary Examiner*—Victor Batson
(74) *Attorney, Agent, or Firm*—Wegman, Hessler & Vanderburg

(57) ABSTRACT

A discharge chute locking assembly for use on a discharge chute assembly of a snow throwing machine includes an outward extending receiving flange on a first component of the chute assembly and an outward extending chute mounting flange on a second component of the chute assembly. The chute mounting flange is configured to be positioned in an abutting relationship with the receiving flange and has at least one key hole and at least one recess and slot combination in registration with the at least one key hole. A locking lever locks the chute mounting flange to the receiving flange. The locking lever includes an elongate body having an inwardly extending ledge, a pivot end and a locking end. The pivot end has a pivot tab extending therefrom sized and shaped to fit through the key hole when the locking lever is in a first orientation and wherein pivot tab is prevented from fitting through the key hole when the locking lever is in a locked orientation. The locking lever also has a locking tab extending from the locking end of the body. When the locking lever is in the locked configuration, the locking tab is configured to be received in the recess such that the tooth engages the slot and the ledge engages the receiving flange to lock the mounting flange to the receiving flange.

21 Claims, 4 Drawing Sheets

CHUTE RETENTION DEVICE

BACKGROUND OF THE INVENTION

1. Field of Invention

This invention relates a discharge chute for a snow throwing machine, and more particularly, to a mounting assembly for the discharge chute.

2. Description of Related Art

Snow throwing machines designed to remove snow from sidewalks, driveways and roadways after a snowstorm are well known in the art. Snow throwing machines can be mounted to a motor vehicle such as a tractor or can be walk-behind models that are self-propelled or manually pushed by the operator. Typically, snow throwing machines have a housing with a front opening through which snow is taken in as a powered rotating member, such as an impeller or paddle, cuts or sweeps the snow. The impeller is rotated by a power source, such as an internal combustion engine mounted on the snow thrower.

Snow throwing machines also include some type of adjustable snow deflecting device, e.g., a chute, deflector, or set of vanes, which selectively directs the thrown snow either forwardly or to the side of the snow throwing machine. Typically the deflecting device, henceforth called the "chute" for convenience, is connected to the housing toward over a housing opening near the rotating member. As will be described further below, the present invention particularly concerns the chute and its interconnection with the snow throwing machine.

Attempts have been made to construct snow throwing machine such that they can be rendered compact for shipping and when not in use. From the manufacturers' standpoint, a machine which can be easily disassembled or generally made more compact is desirable since it can be shipped and stored in a smaller, more economical container, thus saving on the space required to ship and store the machine. Additionally, it is desirable to have a snowthrower which can be easily folded or disassembled into a very compact state for storage purposes. However, it is also desirable that the snow throwing machine be easily assembled by the customer, preferably without the need of tools or extra fastening components, such as screws, bolts and nuts.

The present invention addresses the snowthrower compactibility problem discussed above, and in particular is directed toward a snow thrower discharge chute that can be shipped in a disassembled condition but easily assembled without the need for tools or extra fastening components.

SUMMARY OF THE INVENTION

The present invention provides a discharge chute assembly for use on a snow throwing machine. The chute assembly includes a chute adapter having a first end for mounting to the machine and a second end, the second end comprising a radially outward extending receiving flange. The chute assembly also includes an upper chute mountable on the chute adapter, the upper chute having a chute mounting flange configured to be positioned in an abutting relationship with the receiving flange. The mounting flange includes at least one key hole and at least one recess and slot combination in registration with the at least one key hole. The chute assembly also includes at least one locking lever for locking the upper chute to the chute adapter. The locking lever has an elongate body with a pivot end and a locking end, the body having a base portion and a ledge extending in an inward direction from the base portion. The locking lever also includes a pivot tab extending from the pivot end of the body, the pivot tab including a post and a locking nub forming a generally inverted L-shaped formation. The post and nub are sized and shaped to fit through the key hole when the locking lever is in a first orientation are prevented from fitting through the key hole when the locking lever is in a locked orientation. The locking lever also includes a locking tab extending from the locking end of the body, the locking tab having a tooth extending from a distal end thereof. When the locking lever is in the locked configuration, the locking tab is received by the recess such that the tooth is inserted into the slot to hold the locking lever in the locked orientation, and the ledge engages the receiving flange to hold the mounting flange against the receiving flange in an abutting relationship to lock the upper chute to the chute adapter.

In another embodiment, the invention is a discharge chute locking assembly for use on a discharge chute assembly of a snow throwing machine. The discharge chute locking assembly includes an outward extending receiving flange on a first component of the chute assembly and an outward extending chute mounting flange on a second component of the chute assembly. The chute mounting flange is configured to be positioned in an abutting relationship with the receiving flange and has at least one key hole and at least one recess and slot combination in registration with the at least one key hole. A locking lever locks the chute mounting flange to the receiving flange. The locking lever includes an elongate body having an inwardly extending ledge, a pivot end and a locking end. The pivot end has a pivot tab extending therefrom sized and shaped to fit through the key hole when the locking lever is in a first orientation and wherein pivot tab is prevented from fitting through the key hole when the locking lever is in a locked orientation. The locking lever also has a locking tab extending from the locking end of the body. When the locking lever is in the locked configuration, the locking tab is configured to be received in the recess such that the tooth engages the slot and the ledge engages the receiving flange to lock the mounting flange to the receiving flange.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
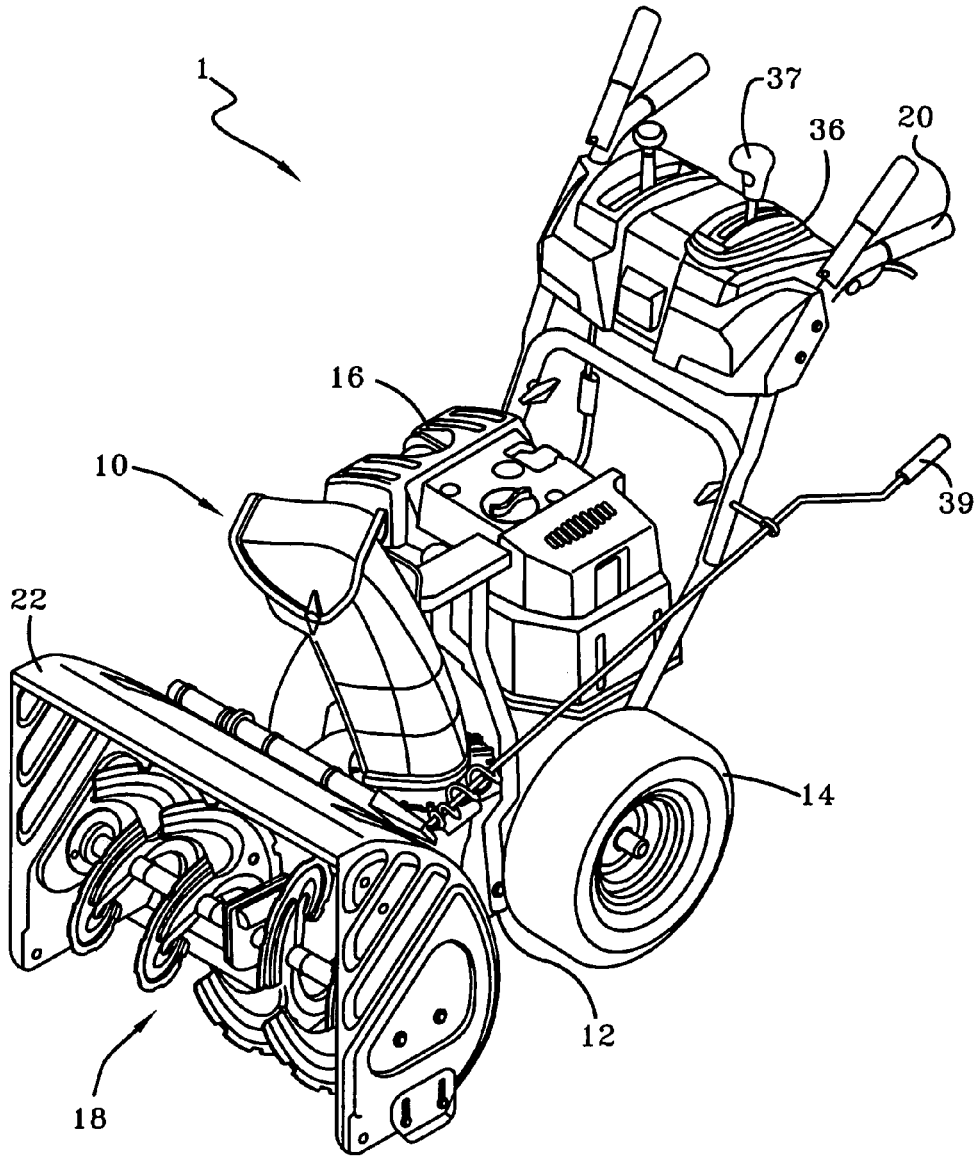
FIG. 1 illustrates a snow throwing machine having a discharge chute assembly according to one aspect of the invention.

Referring now to FIG. 1, a walk-behind snow throwing machine is shown at 1 having a discharge chute assembly 10 through which snow being expelled by the snow throwing machine is directed. The snow throwing machine 1 includes a frame 12 and ground-engaging wheels 14, operatively coupled to the frame. A power source 16, such as an internal combustion engine or other suitable power source, is fixedly attached to the frame 12 and provides power for operating a snow-gathering unit, indicated generally 18, attached to the front end of the snow throwing machine 1. Those skilled in the relevant art will appreciate that the engine 16 may be operatively and selectively coupled to the snow gathering unit 18 through a variety of power conveying techniques and approaches, including but not limited to clutches, belts, pulleys, etc. The power source 16 may also be used to provide rotational power to the ground-engaging wheels 14. The snow throwing machine 1 also includes handles 20, which are rigidly connected to the frame 12 so that an operator may maneuver the snow thrower as desired. The snow-gathering unit 18 includes a housing 22 carried upon the frame 12. In the illustrated embodiment, the discharge chute assembly 10 is used on snow throwing machine 1, however, the discharge chute assembly may be used on other machines chosen with sound engineering judgment such as leaf blowers, lawn mowers and the like.

The discharge chute assembly 10 communicatively cooperates with an opening (not shown) in the housing 22 to receive the snow being gathered by the snow gathering unit 18 and expel it from the snow throwing machine 1 in the intended direction of dispersion. Discharge chute assembly 10 includes a chute adapter 30 and an upper chute 32 which are interconnected at interface 34. The chute adapter 30 is pivotably mounted on the frame 12 using means known to one skilled in the art so that the chute assembly 10 can be positioned to the desired angle for directing the snow away from the snow throwing machine 1. The snow throwing machine 1 further includes a console or control panel 36 from which extends a joystick or control lever 37. The control lever 37 is used as a remote control device for rotational positioning of the chute assembly 10. Those skilled in the relevant art will appreciate that the positioning of the chute assembly 10 may alternatively be controlled via a chute crank assembly 39, a remote crank assembly (not shown), or a cable assembly (not shown).

Figure 2:
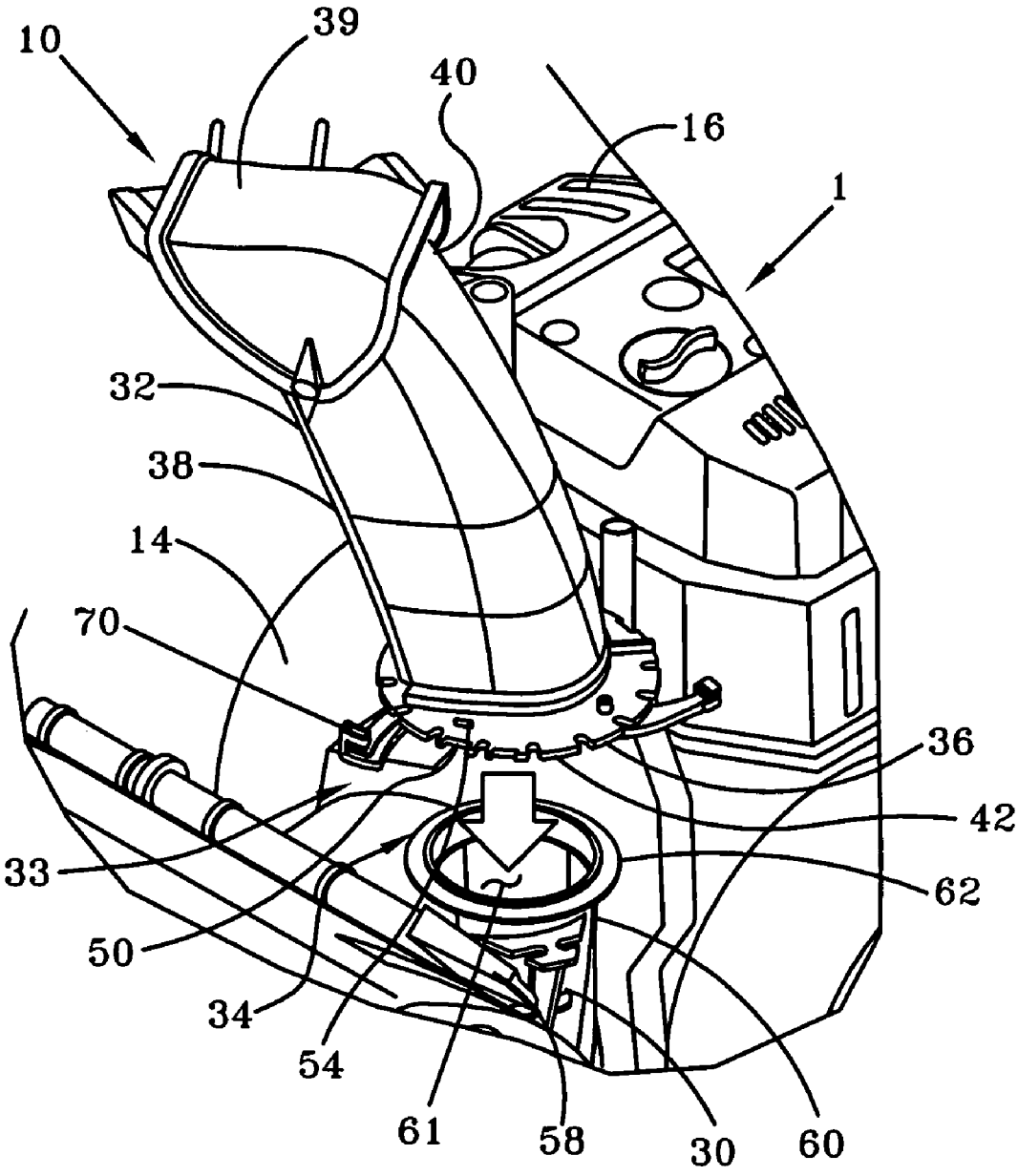
FIG. 2 is an exploded perspective view of the discharge chute assembly of FIG. 1.

Referring now to FIG. 2, the invention primarily pertains to the discharge chute assembly 10 and the manner in which the upper chute 32 is mounted on the chute adapter 30 using a chute locking assembly, shown generally at 33. Oftentimes, it is desirable to ship the snow throwing machine 1 from the manufacture with the upper chute 32 disassembled from the machine to reduce the packaging size for the snow thrower. However, it is preferable that the customer be able to quickly assemble the chute assembly 10 without the need of hand tools or the need to install numerous bolts, screws or other fasteners to the chute assembly 10. With the chute assembly 10 of the present invention, the upper chute 32 can be shipped ready for assembly so that the customer can install the upper chute 32 without the need for tools and without the need to install other fastening hardware. As such, shipping and assembly of the snow throwing machine 1 is facilitated.

Referring now to FIGS. 2 and 3A–3C, in one embodiment of the chute locking assembly 33, the upper chute 32 has a generally circular mounting end 36 and an elongate chute body 38 with a discharge end 40 for allowing the egress of snow. In the illustrated embodiment, the chute body 38 is generally U-shaped, however, one skilled in the art will understand that other body shapes, such as oval, hexagonal, and the like, can be used to produce a compact, high velocity snow stream without departing from the scope of the invention. A deflector 39 may be pivotably attached to the discharge end 40 of the upper chute 32 using means known to one skilled in the art to further direct the expelled snow. A chute mounting flange 42 extends radially outward from the mounting end 36 of the upper chute 32. Preferably, the mounting flange 42 is integrally molded with the chute body 38. The chute mounting flange 42 desirably extends between about 0.5 inches (1.3 cm) to about 2.0 inches (5.1 cm), and more preferably about 1.0 inch (2.5 cm), beyond the outer perimeter of the chute body 38 over a substantial portion of the flange to provide a mounting surface as will be described below. The chute mounting flange 42 desirably has a thickness of between about 0.1 inches (0.3 cm) to about 0.3 inches (0.8 cm).

At least one key hole 44 is located in the chute mounting flange 42, the purpose of which will be described further below. Desirably, the key hole 44 is shaped such that one dimension of the key hole (i.e., the length) is greater than the other dimension (i.e., the width). In the illustrated embodiment, the key hole 44 has a first bulbous portion 46 and a second slot portion 48, such that the combined length of the bulbous portion and slot portion is greater than the width of the bulbous portion. The chute mounting flange 42 also has a recess 50 in an outer peripheral edge 52 of the flange and a through slot 54 positioned inward from the recess. The recess 50 and slot 54 are registered with the key hole 44, the purposes of which will also be described below. The recess 50 preferably has a width of between about 0.5 inches (1.3 cm) to about 1.0 inches (2.5 cm) and a depth of between about 0.1 inches (0.3 cm) to about 0.3 inches (0.8 cm) although other sizes are contemplated. The slot 54 is preferably separated from the recess 50 by about 0.2 inches (0.6 cm) to about 0.5 inches (1.3 cm) to form a neck 56 in the chute mounting flange 42. In the illustrated embodiment, the chute mounting flange 42 has three key holes 44 with three associated recesses 50 and slots 54 spaced around the circumference of the flange. However, other numbers of key holes 44 and corresponding recesses 50 and slots 54, such as one, two, four, or more, can be used.

The chute adapter 30 has a tube-like body 58 leading to an outer end 60 forming an opening 61 for allowing the snow to pass from the snow gathering unit 18 (FIG. 1) to the upper chute 32. The outer end 60 is sized and shaped substantially similar to the mounting end 36 of the upper chute 32 so as to provide a smooth transition at the interface 34. In the illustrated embodiment, the outer end 60 is generally circular, although other shapes can be used without departing from the scope of the invention. A receiving flange 62 extends radially outward from near the outer end 60 of the chute adapter 30. The receiving flange 62 is configured to receive the chute mounting flange 42 of the upper chute 32 in an abutting relationship. In the illustrated embodiment, the receiving flange 62 is generally circular in shape and preferably has an outer peripheral edge 64 between about 0.2 inches (0.6 cm) to about 1.0 inches (2.5 cm) beyond the outer circumference of the adapter body 58, and more desirably between about 0.3 inches (0.8 cm) to about 0.5 inches (1.3 cm) beyond the adapter body. Accordingly, the receiving flange 62 has an outer diameter that is smaller than the outer diameter of the chute mounting flange 42, so that when the chute mounting flange and the receiving flange are placed in an abutting relationship, the chute mounting flange extends past the receiving flange. The receiving flange 62 desirably has a thickness between about 0.1 inches (0.3 cm) to about 0.3 inches (0.8 cm) and more preferably between about 0.15 inches (0.3 cm) and about 0.2 inches (0.5 cm).

The upper chute 32 is lockingly attached to the chute adapter 30 with at least one locking lever 70. In the illustrated embodiment, three locking levers 70, spaced roughly 120 degrees apart, lock the upper chute 32 to the chute adapter 30. Each locking lever 70 is desirably substantially similar to the other locking levers. Therefore, only one locking lever 70 will be described below and the structure of the remaining locking levers can easily be understood from the description. The upper chute 32 and locking lever 70 are preferably made of a durable material such as nylon, plastic, polycarbonate and the like using known molding techniques understood by one skilled in the art.

Figure 4:
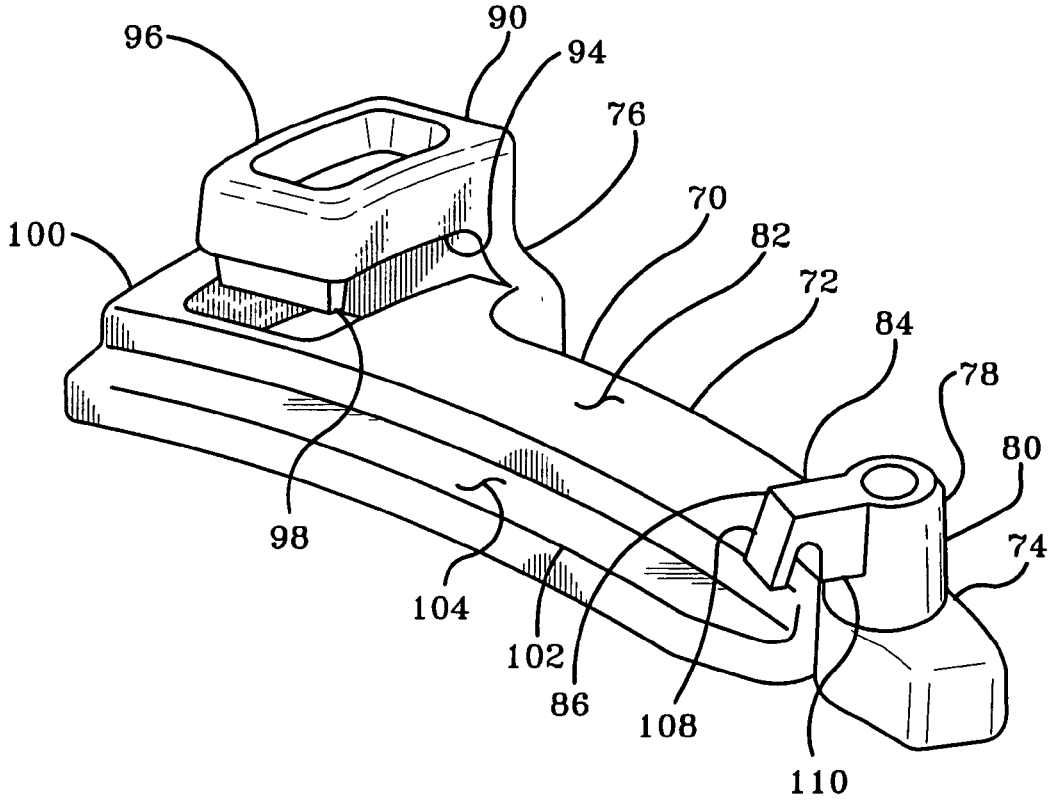

Turning now to the enlarged view of the locking lever 70 shown in FIG. 4, the locking lever comprises an elongate body 72 having a first pivot end 74 and a second locking end 76. A pivot tab 78 extends from the pivot end 74 of the body 72. In one embodiment, the pivot tab 78 includes a post 80 extending from an upper surface 82 of the elongate body 72. As used herein, the terms "upper" and "lower" refer to the orientation of the drawings and are not intended to be limiting with respect to the invention. A locking nub 84 extends from an upper portion of the post 80 thereby generally forming an inverted L-shaped formation. The shape of the pivot tab 78 forms a downward facing ledge 86 or engagement surface for engaging the surface of the chute mounting flange 42 when the locking lever is installed on the upper chute 32.

The locking end 76 of the locking lever 70 has a locking tab 90 extending from the upper surface 82 of elongate body 72. The locking tab 90 includes a neck 94 extending from the upper surface 82 of the elongate body 72. An arm 96 extends from an upper portion of the neck 94 thereby forming an inverted L-shaped formation. A tooth 98 extends downward from a distil end of the arm 96.

The elongate body 72 further has a base portion 100 and a ledge 102 extending inward from a lower portion of the base portion. An upper surface 104 of the ledge 102 is configured to engage the lower surface (not shown) of the receiving flange 62 as will be described below when the locking lever is used to lock the upper chute 32 on the chute adapter 30. The elongate body 72 of the locking lever 70 desirably has an arcuate shape similar to the curvature of the peripheral edge 52 of the chute mounting flange 42. The pivot tab 78 and locking tab 90 are separated on the elongate body 72 by between about 1.0 inches (2.5 cm) and 4.0 inches (10 cm) to provide the desired surface base for the ledge 102 to engage the receiving flange 62.

Figure 3C:
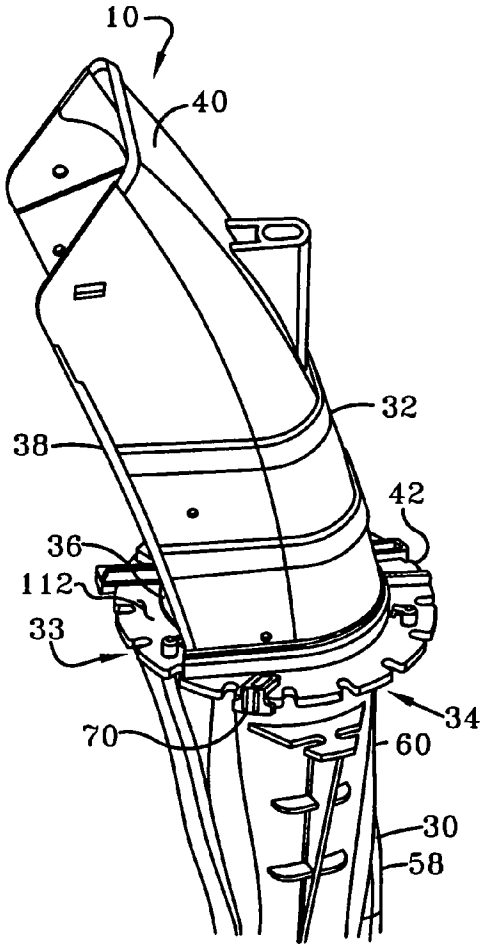
FIG. 3C is a perspective view similar to FIG. 3A with the discharge chute assembly in a fully assembled configuration and FIG. 4 is an enlarged perspective view of the locking lever of FIG. 2.
Figure 3B:
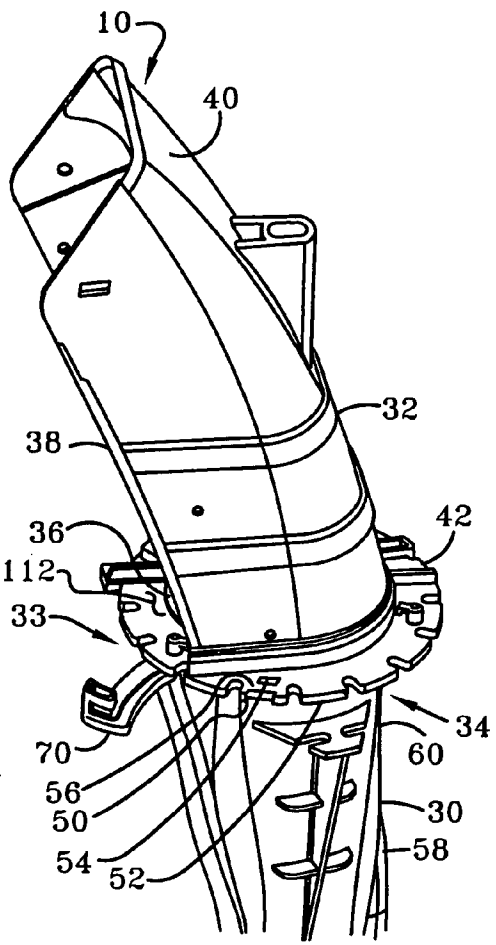
FIG. 3B is a perspective view similar to FIG. 3A with the discharge chute assembly in a partially assembled configuration.
Figure 3A:
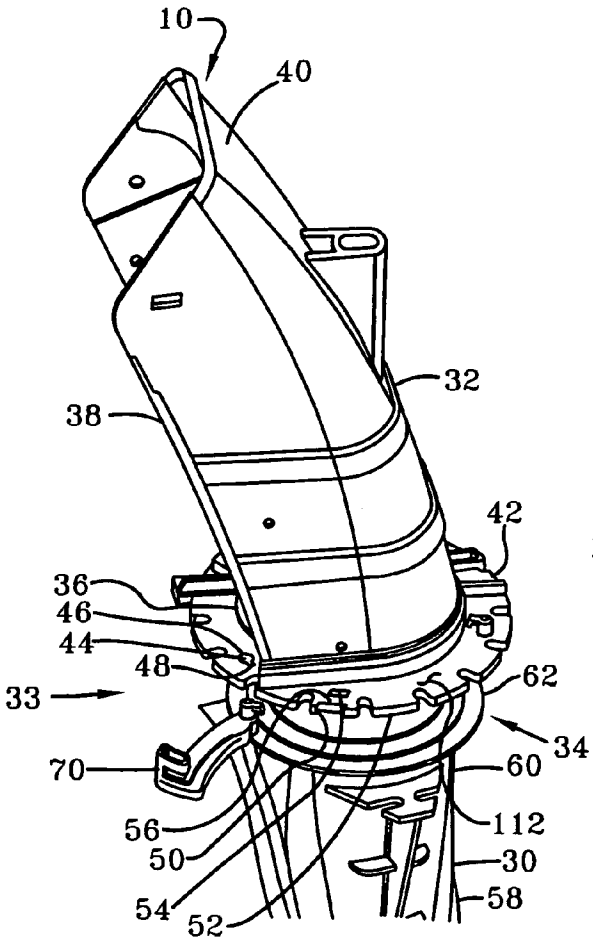
FIG. 3A is an exploded perspective view of the discharge chute assembly of FIG. 1 illustrating a locking lever used in assembly of the chute assembly.

The locking lever is pivotally connected to the chute mounting flange 42 of the chute assembly 10 at the pivot end 74 as illustrated in the successive stages of assembly shown in FIGS. 3A–3C. As shown in FIGS. 3A and 3B, the post 80 and locking nub 84 pass through the key hole 44 in the chute mounting flange 42. The post 80 and locking nub 84 are sized and shaped to fit through the key hole 44 when the locking lever 70 is in a first orientation as shown in FIGS. 3A and 3B. In such an orientation, the shape of the key hole 44 corresponds to the shape of the post 80 and locking nub 84 such that the post and locking nub fit through the key hole 44. Preferably, a distal end of the locking nub 84 has a lip 108 configured to be compressed back toward the post 80 to aid in fitting the post 80 and locking nub 84 through the key hole 44. Once through the key hole 44, the resilient nature of the lip 108 allows the lip flex back to its original position to aid in locking the post 80 and locking nub 84 in the key hole 44.

The locking lever 70 is then rotated or pivoted about a pivot axis concentric with the central axis of the post 80 to a second, locked orientation as shown in FIG. 3C. In the locked position, a bottom surface 110 of the inverted L-shaped ledge 86 bears on the upper (horizontal) surface 112 of chute mounting flange 42 to prevent the locking lever 70 from being withdrawn from the key hole 44 while in the locked position, thus locking the locking lever 70 on the chute mounting flange 42 of the upper chute 32. Also in this locked position, the locking lever 70 engages the receiving flange 62 of the chute adapter 30 to secure the upper chute 32 against the chute adapter 30 in the assembled position. The ledge 102 formed in the locking lever 70 slides under the receiving flange 62 so that the upper surface 104 of the ledge abuts the lower surface of the receiving flange 62. As the locking lever 70 reaches the locked position, the locking tab 90 at the locking end 76 is received in the recess 50 so the outer portion of the locking end is substantially flush with the outer peripheral edge 52 of the chute mounting flange 42 and a majority, if not all, of the elongate body 72 slides under the chute mounting flange 42. Thus, the locking lever 70 is hidden and protected by the chute mounting flange 42 to minimize damage to or unintentional disassembly of the discharge chute assembly 10. The neck portion 56 of the chute mounting flange 42 between the recess 50 and the slot 54 is received in the space between the arm 96 and the body 72 such that the tooth 98 locks into the slot 54 in the chute mounting flange 42. The recess 50 and slot 54 are registered with respect to the key hole 44 to accommodate the desired length of the locking lever 70 so that the locking tab 76 is received in the recess and snaps into the slot 54.

Prior to using the snow throwing machine 1 to throw snow, the discharge chute assembly 10 is assembled by positioning the upper chute 32 such that chute mounting flange 42 resides in an abutting relationship adjacent the receiving flange 62 of the chute adapter 30. The upper chute 32 is desirably shipped from the manufacture with the locking lever 70 already attached to the mounting flange 42. The upper chute 32 is attached by pivoting the locking levers 70 such that the upper chute 32 is locked in that position by rotating members 56 such that their inner edges 60 come into contact with chute mounting flange 42. Once the locking levers 70 have been fully rotated toward their locked positions, the locking levers conveniently do not extend past the chute mounting flange 42 so that there is minimal chance of breaking the locking lever 70 or inadvertently pivoting the locking levers into the unlocked position. As stated above, in the illustrated embodiment, the discharge chute assembly 10 contains three locking levers 70 spaced around the periphery of the chute assembly 10 to securely fasten to the upper chute 32 to the chute adapter 30. In such a way, a snow throwing machine operator can securely mount the upper chute 32 on the chute assembly without using a tool such as a screwdriver. Additionally, minimal parts are required as there is no need for wing nuts or other fasteners to thread on a bolt to assemble the chute assembly 10. Following the snow throwing operation, if it is desirable to store or transport the snow throwing machine 1 in a very compact state or if it necessary to replace a broken upper chute 32, it is simply necessary to disassemble the chute assembly by reversing the above process in order to remove the upper chute 32 from the chute adapter 30.

In the illustrated embodiment, the locking lever 70 is mounted on the flange extending from the upper chute 32 and pivots to engage the flange extending from the chute adapter 30. One skilled in the art will understand that this orientation may be reversed such that the locking lever 70 is mounted on the flange extending from the chute adapter 30 and pivots to engage the flange extending from the chute adapter 30 without departing from the scope of the invention.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A discharge chute assembly for use on a snow throwing machine, the chute assembly comprising:

a chute adapter having a first end for mounting to the machine and a second end, said second end comprising a radially outward extending receiving flange;

an upper chute mountable on the chute adapter, the upper chute having a chute mounting flange configured to be positioned in an abutting relationship with the receiving flange, said mounting flange comprising at least one key hole and at least one recess and slot combination in registration with said at least one key hole; and at least one locking lever comprising:

an elongate body having a pivot end and a locking end, said body comprising a base portion and a ledge extending from the base portion;

a pivot tab extending from the pivot end of the body, said pivot tab comprising a post and a locking nub forming a generally inverted L-shaped formation wherein said post and nub are sized and shaped to fit through the key hole when the locking lever is in a first orientation, and wherein said post and nub are prevented from fitting through the key hole when the locking lever is in a locked orientation; and a locking tab extending from the locking end of the body, said locking tab having a tooth extending from a distal end thereof, wherein when the locking lever is in said locked configuration, said locking tab is received by said recess such that said tooth is at least partially inserted into the slot to hold the locking lever in the locked orientation;

wherein when the locking lever is in said locked configuration, the ledge engages the receiving flange to hold the mounting flange against the receiving flange in an abutting relationship to lock the upper chute to the chute adapter.

2. The discharge chute assembly of claim 1 wherein the pivot tab has a shape corresponding to the shape of the key hole.

3. The discharge chute assembly of claim 1 comprising three locking levers positioned about the chute assembly, wherein each locking lever is configured to operatively engage an associated key hole, recess and slot combination.

4. The discharge chute assembly of claim 1 wherein the locking lever has an arcuate body, said arcuate body having a shape corresponding to a curvature of the chute mounting flange.

5. The discharge chute assembly of claim 1 wherein the locking tab comprises a neck and an arm forming an inverted L-shaped configuration.

6. The discharge chute assembly of claim 1 wherein the locking nub comprises a lip on a distal end thereof, said lip being resiliently compressed to fit the locking nub through the key hole.

7. The discharge chute assembly of claim 1 wherein the at least one locking lever locks the upper chute to the chute adapter without additional fasteners.

8. The discharge chute assembly of claim 1 wherein the key hole is shaped such that a length of the key hole is greater than a width of the key hole.

9. The discharge chute assembly of claim 1 wherein the chute mounting flange entirely overlaps the locking lever body when the locking lever is pivoted to the locked orientation.

10. A discharge chute locking assembly for use on a discharge chute assembly of a snow throwing machine, the chute assembly comprising:

an outward extending receiving flange on a first component of the chute assembly;

an outward extending chute mounting flange on a second component of the chute assembly, the chute mounting flange configured to be positioned in an abutting relationship with the receiving flange, wherein said mounting flange comprises at least one key hole and at least one recess and slot combination in registration with said at least one key hole; and a locking lever comprising an elongate body having a pivot end and a locking end, said body having an inwardly extending ledge, the pivot end having a pivot tab extending therefrom sized and shaped to fit through the key hole when the locking lever is in a first orientation and wherein the pivot tab is prevented from fitting through the key hole when the locking lever is in a locked orientation, and said locking end having a locking tab extending therefrom said locking tab having a tooth extending from a distal end thereof, wherein when the locking lever is in the locked configuration, said locking tab is configured to be received in said recess such that said tooth engages the slot in said recess and slot combination and the ledge engages the receiving flange to lock the mounting flange to the receiving flange.

11. The discharge chute locking assembly of claim 10 wherein the receiving flange is mounted on a chute adapter having a first end for mounting to the machine and a second end with said receiving flange located near said second end.

12. The discharge chute locking assembly of claim 10 wherein said pivot tab comprises a post and a locking nub forming a generally L-shaped configuration and sized and shaped to fit through the key hole when the locking lever is in a first orientation, and wherein said post and locking nub are prevented from fitting through the key hole when in a locked orientation.

13. The discharge chute locking assembly of claim 10 wherein the chute mounting flange is mounted on an upper chute member, the upper chute member having a discharge end and a mounting end, with the chute mounting flange located at said mounting end.

14. The discharge chute locking assembly of claim 10 wherein the locking tab comprises a neck and an arm forming an inverted L-shaped configuration.

15. The discharge chute locking assembly of claim 10 wherein the pivot tab has a shape corresponding to the shape of the key hole.

16. The discharge chute locking assembly of claim 10 comprising three locking levers positioned about the chute assembly, wherein each locking lever is configured to operatively engage an associated key hole, recess and slot combination.

17. The discharge chute locking assembly of claim 10 wherein the locking lever has an arcuate body, said arcuate body having a shape corresponding to a curvature of the chute mounting flange.

18. The discharge chute locking assembly of claim 10 wherein the pivot tab comprises a locking nub having a lip on a distal end thereof, said lip being resiliently compressed to fit the locking nub through the key hole.

19. The discharge chute locking assembly of claim 10 wherein the locking lever locks an upper chute to a chute adapter of a discharge chute assembly without additional fasteners.

20. The discharge chute locking assembly of claim 10 wherein the key hole is shaped such that a length of the key hole is greater than a width of the key hole.

21. The discharge chute locking assembly of claim 10 wherein the chute mounting flange entirely overlaps the locking lever body when the locking lever is pivoted to the locked orientation.

* * * * *